United States Patent [19]

Lee

[11] Patent Number: 4,722,520

[45] Date of Patent: Feb. 2, 1988

[54] ROWING EXERCISE MACHINE

[76] Inventor: Wen-Kuei Lee, No. 10, Lane 223, Long Jiang Road, Taipei, Taiwan

[21] Appl. No.: 630,829

[22] Filed: Jul. 13, 1984

[51] Int. Cl.[4] ..... A63B 69/06

[52] U.S. Cl. ..... 272/72; 272/130

[58] Field of Search ..... 242/72, 130, 143, 96

[56] References Cited

U.S. PATENT DOCUMENTS

| | | | |
|---|---|---|---|
| 368,111 | 8/1887 | Reach | 272/72 |
| 4,057,246 | 11/1977 | Wilson | 272/143 X |
| 4,111,416 | 9/1978 | Jinotti | 272/96 |
| 4,488,719 | 12/1984 | Brown et al. | 272/130 X |

FOREIGN PATENT DOCUMENTS

| | | | |
|---|---|---|---|
| 0202621 | 10/1908 | Fed. Rep. of Germany | 272/72 |
| 2309253 | 11/1976 | France | 272/72 |
| 2511879 | 3/1982 | France | 272/72 |

*Primary Examiner*—Richard J. Johnson

*Attorney, Agent, or Firm*—Asian Pacific International Patent & Trademark Office

[57] ABSTRACT

The rowing exercise apparatus includes a frame structure on which is mounted at one end a seat for supporting a user in seated position. A pedal mechanism for positioning the feet of the user thereon is provided at the foot end of the frame. On each longitudinal side of the frame, there is provided a scully-type or rowing mechanism. Each rowing mechanism typically includes (a) a pivotally mounted swing rod assembly including a swing rod, (b) a swinging mechanism including a cylinder and piston rod assembly, (c) a compound connector for regulating the swinging mechanism, and (d) a respective swinging arm carrying a movable handle. The swinging arm is connectable to the connector in such a way so as to allow adjustment of the swinging action of the swinging arm.

3 Claims, 3 Drawing Figures

ROWING EXERCISE MACHINE

CROSS-REFERENCE TO RELATED APPLICATIONS

None.

BACKGROUND OF THE INVENTION

Field of the Invention

The invention may be classified in class 272 and appropriate sub-classes.

In this highly developed industrial and booming business society, almost every person is living in a highly stressed environment, and is likely doing some monotonous work. These phenomena are products of a highly developed technological era; and people live in a society that is competitive for minutes or even seconds, having less time for outdoor exercise or relaxation. Time available for outdoor exercises may be limited by bad weather. To be useful, exercise should be conducted to relax the rushing and strained mind and body in one's free time in order for the physical condition to be able to meet new challenges.

Currently, there are many kinds of sculler or rowing equipment. However, most of them can only be pulled back and forth for exercise purpose. In fact, they should probably not be referred to as "sculler gymnastic or exercise apparatus". Although some of those sculler apparatus may be able to allow up-and-down and left-and-right swinging, their swinging angles are limited, and they may give a sticky, restraining or catching-binding feeling during rowing because their hydraulic cylinder is fixed on a shaft with two cross joints. Because the two cross joints are separate joints, the swinging angles during rowing between the two joints are definitely different. Furthermore, upon the piston rod extending longer, the angle of deviation between the two cross joints becomes more prominent. However the greater the angle of deviation becomes, the greater will be the limit on the up-and-down movement of the joints. Also, the piston inside the cylinder may not move back and forth in straight manner, because of the two cross joints not being swung left and right synchronously and in straight manner. Consequently, the sculler does not fully enjoy the sculler exercises, but often gets the feeling that "the boat is stranded". The drawback often causes damages to the sculling equipment and reduces the serviceable life of the equipment. Thus, the apparatus with the cross joints is not a preferable design.

OBJECTS OF THE INVENTION

In view of the aforementioned drawbacks, the inventor has developed a sculler-type gymnastic or exercise apparatus that can be used to carry out rowing or sculling motions.

The objects include the provision of an apparatus of the type briefly described with which a wider swinging angle on the swinging arms is feasible and without generating a feeling during the rowing exercise which suggests a resisting, stiff or sticky feel or attitude of the apparatus and which precludes a dead angle.

SUMMARY OF THE INVENTION

This invention provides a sculler type exercise apparatus, particularly a sculler exercise or gymnastic apparatus which allows rowing motions to be carried out by the swinging arms at a wider angle. The features of this invention include rotary axles engaged with a swinging rod, a movable joint with a hydraulic cylinder, whereby the swinging arm can be swung up-and-down for the to-and-fro motion of rowing, as well as left-and-right. The assembly also includes a regulating head mounted on the swinging arm so as to allow adjustments of the swinging radius of the swinging arm, and a pedal means mounted with a spring for providing exercise in leg portion. All these features contribute to provision of a complete sculler gymnastic or rowing-type exercise.

SPECIFIC DESCRIPTION

Figure 1:
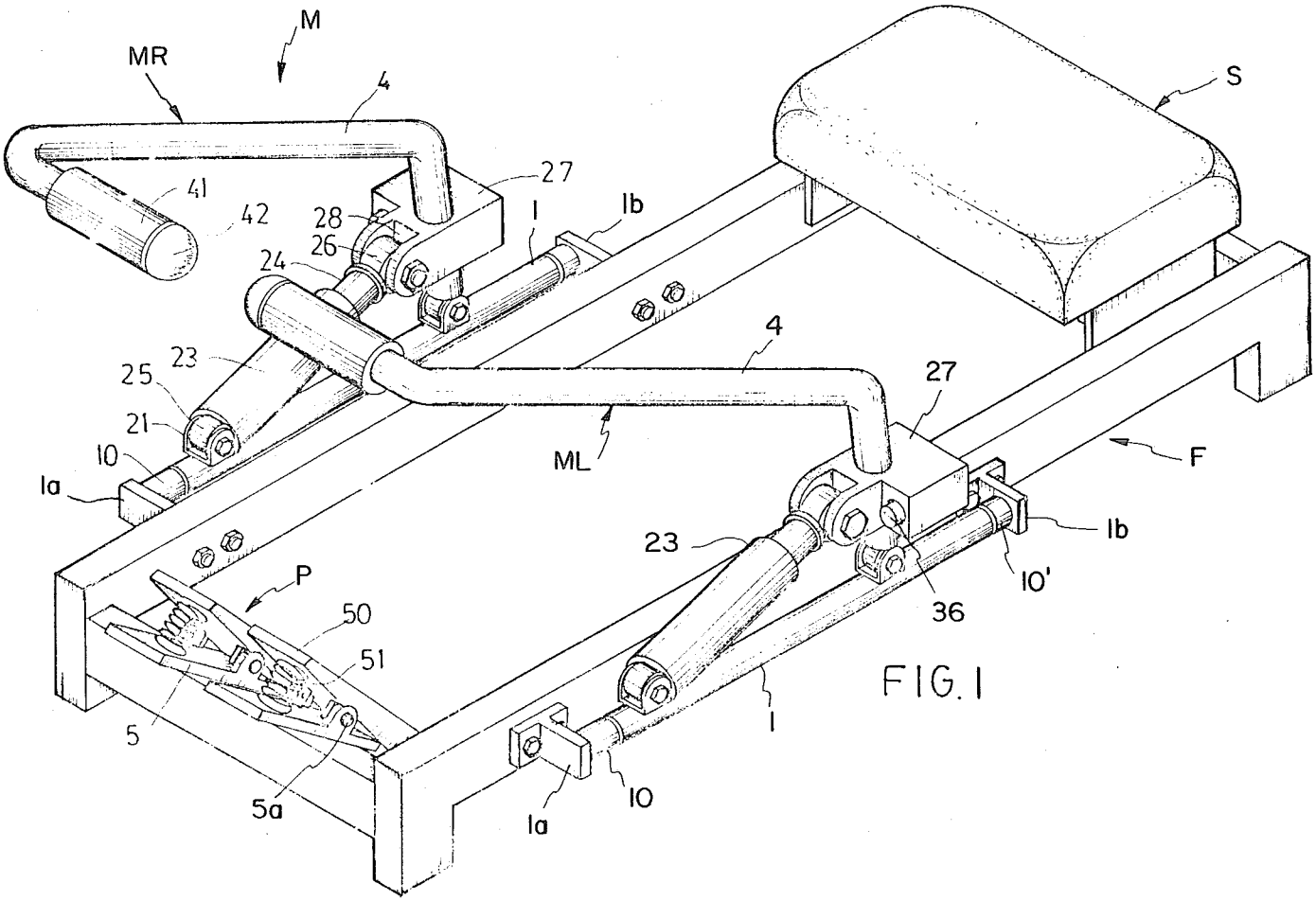
FIG. 1 is a perspective view of a complete apparatus in accordance with one embodiment of my invention.

In the drawing like reference characters designate like elements in the various views of the drawings.

The apparatus according to my invention generally includes a frame structure F on which is mounted at one end a seat S for supporting a user in seated position. A pedal mechanism P for positioning the feet of the user thereon is provided at the foot end of the frame F. On each longitudinal side of the frame F, there is provided a scully-type or rowing mechanism M, i.e. a left mechanism $M_L$ and a right mechanism $M_R$.

Each mechanism $M_L$, and $M_R$, includes parts identically found in the other, and exceptions to this rule will be described as the description proceeds.

Figure 2:
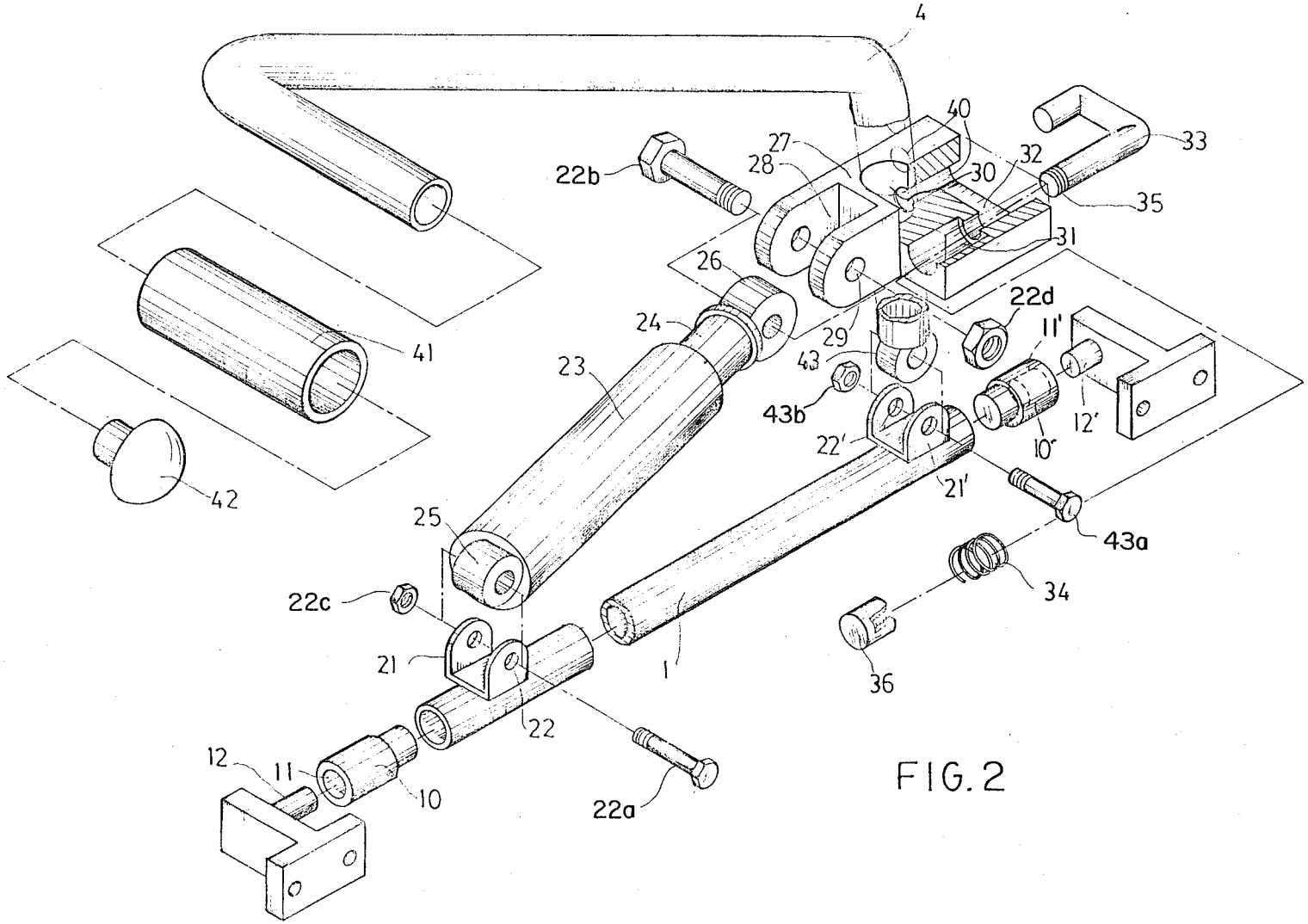
FIG. 2 is a perspective exploded view of one of the operating mechanism for the apparatus in FIG. 1.

With particular reference to FIG. 2, a longitudinal swing rod 1 is mounted between T-shaped holders 1*a* and 1*b*, with a joint 10 being provided for the forward end at holder 1*a*, and joint 10' being provided for the rearward end of the swing rod 1 at the holder 1*b*. The joints 10 and 10' have two different outer diameters respectively.

In the center of its larger diameter portion, the rotating joint 10 is formed with a rotary socket 11. A similar rotary socket, not shown, is correspondingly provided in the center of the larger diameter portion of the rotating joint 10'.

The small diameter portions of the rotating joints 10 and 10' are fixedly connected with the inner wall of the swinging rod 1 by means of a pressing technique or method. The rotary sockets 11 and 11' of the rotating joints 10 and 10' are movably connected with the rotary axles 12 and 12' of the holders 1*a* and 1*b*, respectively.

The up-and-down movement of a rowing mechanism according to the present invention firstly includes two U-shaped pivot pieces or clevises, i.e. the forward clevis 21, and the rearward clevis 21', both secured to the swing rod 1. The mechanism also includes a cylinder 23 with a piston rod 24, and further includes a radius regulating head 27. The clevises 21 and 21' have respective holes or bores 22 and 22', and the respective fulcrums for the cylinder 23 and the piston rod 24 are provided by the long bolts 22*a* and 22*b* which are secured by nuts 22*c* and 22*d*, respectively.

The cylinder 23 is mounted by a connector end or joint disc 25 at its forward end in the clevis 21, while the piston rod 24 is connected to the pivot channel or clevis 28 at the radius regulating head 27 by way of a connector end or joint disc 26 at its exterior end. The joint discs 25 and 26 are respectively pivotally connected to the U-shaped pivot piece 21 and the U-shaped pivot channel 28 at the radius control head 27, i.e. they can respectively pivot or turn about the shafts of the long bolts 22*a* and 22*b*.

In the center of the radius regulating head 27, there is a swinging arm hole 30 for receiving the swinging arm 4 of mechanism $M_R$. At one side of the radius regulating head 27, there is a salient or projecting block, the center of which is provided with a spring chamber 31. Beside the chamber 31, there is a fixing pin channel 32 which has a diameter which is smaller than that of the spring chamber 31, and which is to allow room for the fixing pin 33 to move either to the left or the right. The outer diameter of spring 34 is smaller than the inner diameter of the spring chamber 31 so as to allow the spring 34 to move freely therein. However, the inner diameter of the spring 34 is greater than the outer diameter of the fixing pin 33. The end portion of the long leg of the L-shaped fixing pin 33 is furnished with threads 35 which can cooperate with threads in pin button 36, which has a diameter longer than that of the spring 34.

At the end portion of the swinging arm 4 which is inserted in the swinging arm hole 30, there are furnished several round holes 40 which are vertically spaced as positioning holes of swinging arm 4. At the handle end of the swinging arm 4, a movable handle sleeve 41 is mounted in position with a handle positioning catch 42 being pressed into the swinging arm 4.

In line with the end of the swinging arm 4, or secured at this end, which is inserted in the swinging arm hole 30, there is provided a joint disc 43 which is adapted to be mounted in the clevis 21′ by means of the long bolt 43*a* and the nut 43*b*.

Figure 3:
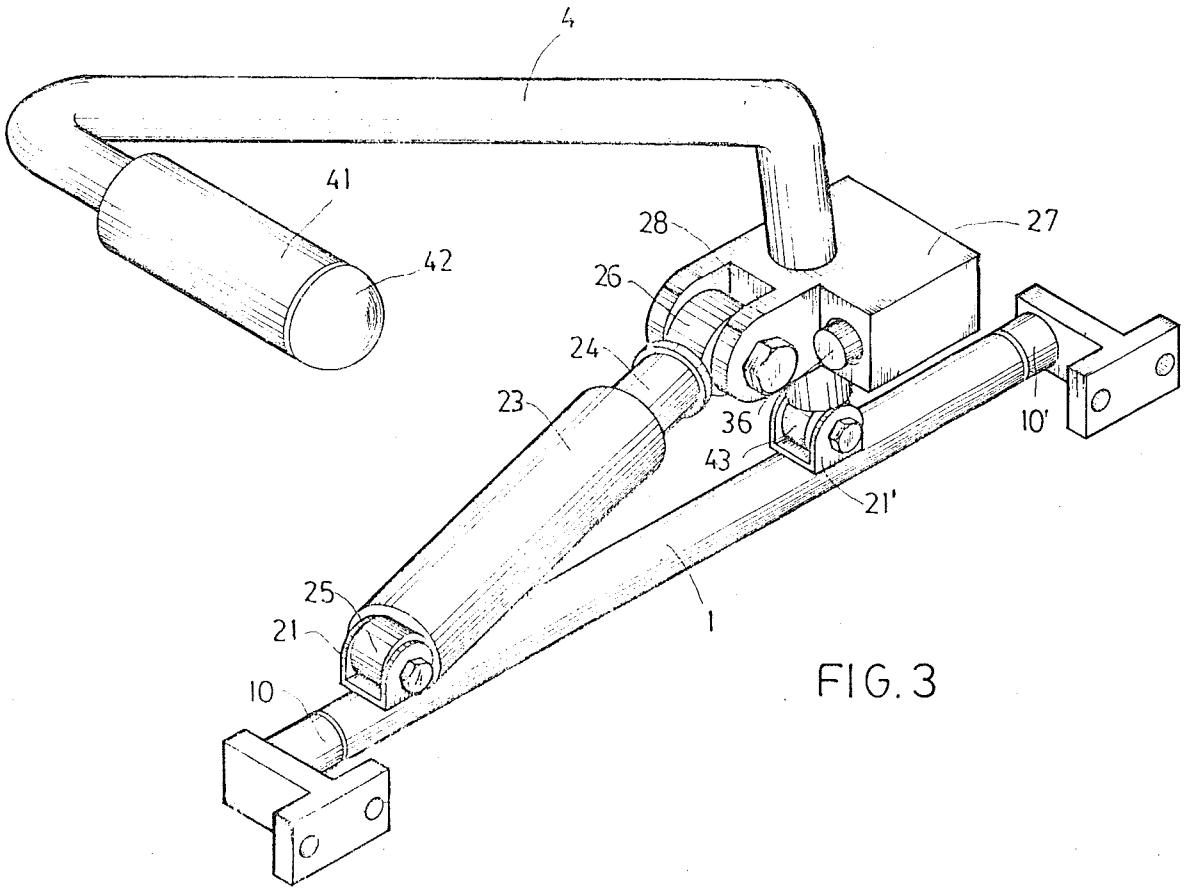
FIG. 3 is a perspective exploded view of the operating mechanism of FIG. 2 but indicating the assembled condition thereof.

In assembling, first press the rotating joints 10 and 10′ made of plastic into the both ends of the swinging rods 1, respectively, see FIGS. 2 and 3. Mount the joint disc 25 with long bolt 22*a* and nut 22*c* in the U-shaped pivot piece 21, and the joint disc 26 with screw or long bolt 22*b* and nut 22*d* in the U-shaped pivot channel 28, respectively in a pivotal manner. Mount the joint disc 43 at the end of swinging arm 4 into the U-shaped pivot piece 21′ with the screw or long bolt 43*a* and the nut 43*b*, also in a pivotal manner.

Put the L-shaped fixing pin 33 into the fixing pin channel 32 to have the long leg of the fixing pin entered into the spring chamber 31 before loading the spring 34 in the chamber 31 to surround the long leg of the fixing pin 33. Next, engage thread the pin button 36 with the threads onto the long leg portion of the fixing pin 33. Put the movable handle sleeve 41 over the swinging arm 4 and position it in place with the handle positioning catch 42 by pressing it inside the swinging arm 4. Accordingly, the handle sleeve 41 is mounted in a rotary manner on the arm 4.

Referring to FIG. 1, there is shown a perspective view of complete embodiment of the present invention, in which the pedal mechanism P for each foot comprises a fixed base plate 5 with a salient lug 5*a* which is used as a fulcrum to support the movable pedal 50 to move in pivotal motion somewhat like a seesaw. A spring 51 is mounted between the fixed plate 5 and the movable pedal 50. Upon operating the swinging arm 4, the operator's feet may simultaneously step on the movable and elastic pedals 50 to give the feeling of being operating in an actual sculling manner.

For a desired operation with a corresponding inclination of the cylinder 23 and piston rod 24, push down the pin button 36 so as to have the short leg of the L-shaped fixing pin 33 disengaged from the swinging arm 4, which for this purpose may be furnished with suitable depressions or apertures which can be aligned with the respective positionng hole 40 for the swinging arm 4, in order to adjust the swinging arm 4 to a desired swinging radius and/or action. Thus, the exterior end of the piston rod 24 can be positioned at selected levels at the end of the swinging arm 4 which is mounted in the swinging arm hole 30 of the regulating head 27.

Next, release the pin button 36, and insert the fixing pin 33 into a positioning hole 40 selected to fix the swinging arm 4 in place. Upon rowing the swinging arms 4, i.e. the right arm 4 of the right mechanism $M_R$ and the left arm 4 of the left mechanism $M_L$, the rotating joints 10 and 10′, and the rotary sockets 11 and 11′ will also allow swinging to the left and the right around the rotary axes 12 and 12′, respectively. Simultaneously, the hydraulic cylinders 23 and the piston rods 24 of each mechanism will also be in reciprocating motion due to being pivotally hinged by the joint discs 25, 26 and 43 at the U-shaped pivot pieces 21 and 21′ and the U-shaped pivot channel 28 with the respective screws or bolts 22*a*, 22*b*, and 43*a*, and nuts 22*c*, 22*d*, and 43*b*.

By means of all the aforementioned motions in the apparatus, one may enjoy exercise something like a real sculling sport.

The present invention is adapted to provide a wider swinging angle during sculling than the conventional sculling apparatus which has virtually no swinging angle. Further, the current sculling apparatus that can swing left and right is limited by two cross joints connected with the hydraulic cylinder. Since there is a distance between the two cross joints, and the swinging (left and right) angle is rigidly limited, unless one carries out perpendicular lateral swinging, there must be an angle of deviation on the left and right sides, and the angle of deviation will vary with the extending length of the piston rod, i.e., the longer the piston rod extends, the wider the angle of deviation will become, and vice versa. Consequently, on pulling or pushing the sculling arms, the user will feel a non-smooth angle or a catch-restraining feeling to exist in the motion-cycle.

In the present invention, the left and right swing mechanism can be rotated with the swing rod 1 around rotary axles; there will be no angle of deviation existing on the joints of the hydraulic cylinder. Since the handles in the embodiment of the present invention are furnished with movable handle sleeves 41 respectively, the operator's hands would not be injured during rowing as is often happening with the conventional handles. Furthermore, the springs 51 mounted under the pedals 50 will provide additional exercises in the feet and legs during rowing.

Summing up the aforesaid description, it is deemed, in comparison with the conventional sculler equipment, my present invention is for an improved design, both in structure and in practicality; moreover, during rowing, the operator's feet and legs will also have suitable exercises. Therefore, it can be considered a unique and up-to-date sculler gymnastic apparatus.

I claim:

1. A sculler-rowing gymnastic apparatus, comprising in combination:

a frame;

a left-side rowing mechanism and a right-side rowing mechanism mounted at respective sides of said frame, each one of said rowing mechanisms including a pivotally mounted swing rod assembly including at least one longitudinally extending rod, a swinging arm having a first end adapted to carry a movable handle, said swinging arm being connected to said swing rod at its second end;

a swing resistance mechanism including at least one cylinder and piston rod assembly connected at one end to said swing rod, and at its other end to said swinging arm, said swing resistance mechanism including connector means slidably adjustably mounted on said swinging arm for adjusting the resistance of said swing resistance mechanism, said connector means being connected to the opposite end of said cylinder and piston rod assembly, a pedal mechanism connected to said frame; and a pair of opposed holders mounted at each side of said frame, each one of said holders including a projecting axle formation, each end of each of said swing rods including a joint adapted to permit rotary motion of each said swing rod with each end of said swing rod being connected to a respective axle at a respective holder.

2. The regulating mechanism of claim 1, which comprises:

a U-shaped fixing pin, said fixing pin having a base, a first leg extending from said base, said first leg having a threaded end, and a second leg extending approximately parallel with respect to said first leg;

a compound connector element, said connector element including a respective U-shaped clevis element for mounting thereat one end of said cylinder and piston rod assembly, said connector element including, in the side which is opposite to that carrying said U-shaped clevis element, a channel for mounting therein the base of said U-shaped fixing pin, with said channel being extended by a first passage adapted to receive therein said second leg of said fixing pin, and with said channel being extended by a second passage adapted to receive therein said first leg of said fixing pin, said second passage being adapted to receive a respective spring;

a pin button having threads adapted to cooperate with the threaded end of said first leg of said fixing pin for retaining said fixing pin when it is disposed in said second passage; and a spring adapted to surround said threaded end of said first leg when mounted in said connector element.

3. The swinging mechanism of claim 1, and further including:

a joint disc connected at the foot end of said cylinder, a joint disc connected at the exterior end of said piston rod, and a joint disc connected at the second end of said swinging arm; and for mounting each joint disc, a respective U-shaped clevis element, whereby said cylinder and piston rod assembly is mounted between said swinging rod and said regulating means, and said second end of said swinging arm is connected to its clevis on said swing rod.

* * * * *